US006554166B2

(12) United States Patent
Sato et al.

(10) Patent No.: US 6,554,166 B2
(45) Date of Patent: Apr. 29, 2003

(54) APPARATUS FOR PRODUCING FINE METAL BALLS

(75) Inventors: Koji Sato, Shimane-ken (JP); Yasushi Ishimoto, Shimane-ken (JP); Gaku Akishige, Shimane-ken (JP); Noboru Hanai, Tottori-ken (JP); Takeshi Kuboi, Shimane-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/805,587

(22) Filed: Mar. 14, 2001

(65) Prior Publication Data

US 2002/0056950 A1 May 16, 2002

(30) Foreign Application Priority Data

| | | |
|---|---|---|
| Mar. 14, 2000 | (JP) | 2000-069567 |
| Mar. 14, 2000 | (JP) | 2000-070535 |
| Jan. 9, 2001 | (JP) | 2001-001190 |
| Feb. 1, 2001 | (JP) | 2001-025979 |

(51) Int. Cl.[7] ..... B22D 41/08

(52) U.S. Cl. ..... 222/594; 222/591; 266/202; 266/236

(58) Field of Search ..... 75/335, 336, 337, 75/338; 264/10; 266/200, 236, 202; 222/591, 594

(56) References Cited

U.S. PATENT DOCUMENTS

| | | | | |
|---|---|---|---|---|
| 3,608,715 A | * | 9/1971 | Snyder et al. | 73/52 |
| 3,937,990 A | * | 2/1976 | Winston | 310/8.3 |
| 5,266,098 A | | 11/1993 | Chun et al. | 75/335 |
| 6,312,498 B1 | * | 11/2001 | Lee et al. | 75/335 |
| 2002/0051728 A1 | * | 5/2002 | Sato et al. | 420/562 |

FOREIGN PATENT DOCUMENTS

| | | |
|---|---|---|
| JP | 59-042161 | 3/1984 |
| JP | 63-065004 | 3/1988 |

* cited by examiner

*Primary Examiner*—Scott Kastler
(74) *Attorney, Agent, or Firm*—Sughrue Mion, PLLC

(57) ABSTRACT

An apparatus for producing fine metal balls comprising a crucible 3 for holding a metal melt and equipped with orifices 2 for ejecting the metal melt; a vibration rod 6 for giving vibration to the melt 1 held in the crucible 3; a vibrator 4 for giving vibration to the vibration rod 6; a means 5 for transmitting the vibration of the vibrator 4 to the vibration rod 6; and a chamber 7 in which melt droplets 9 ejected through the orifices 2 are solidified while dropping, the vibration-transmitting means 5 having one end in contact with the vibrator 4 and the other end abutting a support member 11 connected to the vibration rod 6; the vibration-transmitting means 5 having a cross section decreasing as it nears the support member 11.

14 Claims, 12 Drawing Sheets

APPARATUS FOR PRODUCING FINE METAL BALLS

FIELD OF THE INVENTION

The present invention relates to an apparatus for producing fine metal balls having narrow particle size distribution and high sphericity.

PRIOR ART

There has recently been an increasing demand in extremely many fields for fine metal balls having narrow particle size distribution and high sphericity, such as solder balls used for the microsoldering of semiconductor devices, metal powder for producing sintered alloys by hot isostatic pressing, balls for extremely small ball bearings used for micro-machines, light-emitting particles sealed in metal halide lamps, powder used for pastes, creams or paints for screen printing or immersion coating and other coating machines.

For instance, in the case of solder balls, they are required to be as spherical as possible for use in the assembling of semiconductor devices. Widely used as a technique for mounting semiconductor devices with solder balls is BGA (ball grid array) called CSP (chip size package), MCM (multi-chip module), etc. To connect a semiconductor device to a substrate with a pad of a BGA carrier with a bump, it is necessary to arrange several hundreds of, or in many cases several thousands of, solder balls per an array on the carrier. Also, in semiconductor devices becoming smaller like LSI, VLSI and ULSI, there is an increasingly larger demand for making the solder balls finer, more spherical and narrower in a particle size distribution.

The production of fine metal balls is conventionally carried out by apparatuses using an atomizing method, a uniform droplet spray method, etc. Any of these apparatuses is constituted by a crucible for holding a metal melt and equipped at a bottom thereof with nozzles for ejecting the melt, and a solidification chamber connected to the bottom of the crucible. A cooling system in the solidification chamber may be a gas-cooling system or an in-oil cooling system. For instance, in a gas-cooling apparatus the crucible is pressurized while giving vibration at a constant frequency to the melt, such that the melt is ejected through the nozzles at a constant speed into the solidification chamber, in which the melt is turned to spherical melt droplets by its own surface tension while dropping in the solidification chamber. The spherical melt droplets are cooled by a gas in the solidification chamber to be solidified and deposited on the bottom of the solidification chamber. This gas-cooling system is also called a uniform droplet spray method, suitable for mass-producing fine solidified metal balls having uniform particle size and shape.

For instance, an apparatus disclosed by U.S. Pat. No. 5,266,098 for producing solder balls by a uniform droplet spray method comprises, as shown in FIG. 12, a crucible 3 having a plurality of orifices 2 at the bottom, a vibration rod 6 for vibrating a melt in the crucible 3, a disc 71 connected to thereto, a piezoelectric vibrator 4 connected to the vibration rod 6, a member 81 supporting the piezoelectric vibrator 4 and movable in a vibration direction, and a charging means 85 for giving electric charge to melt droplets dropping from the orifices 2. The melt 1 is ejected through a plurality of orifices 2 at the bottom of the crucible 3, turned to independent melt droplets by vibration given to the melt 1, and solidified.

To produce fine metal balls having a narrow particle size distribution by a uniform droplet-dropping apparatus, it is important to suppress the frequency variation of vibration given to the melt and the speed variation of the melt ejected through the orifices. As a method for giving vibration to the melt at a constant frequency, U.S. Pat. No. 5,266,098 describes a method using a piezoelectric element to give vibration to a melt from outside. Though it may be considered that the melt is ejected at a constant speed because it utilizes the accurate vibration of the piezoelectric element, fine metal balls were not necessarily produced stably by the apparatus of U.S. Pat. No. 5,266,098 shown in FIG. 12, because the apparatus stopped abruptly during a production process. In addition, it has been found that the fine metal balls produced by the apparatus of U.S. Pat. No. 5,266,098 have large variations in a particle size distribution and a sphericity distribution among production lots.

In the apparatus shown in FIG. 12, when the high-frequency vibration of the piezoelectric vibrator 4 is transmitted to the vibration rod 6 and the vibration disc 71 connected thereto, there arises a large concentration of stress in a vibration-transmitting portion from the piezoelectric vibrator 4 to the vibration rod 6. This concentration of stress makes the piezoelectric vibrator 4 unstable, which is considered a main reason of the stop of the apparatus. Also, a stress component in an undesirable direction acts on the vibration-transmitting portion, causing sliding in parts, etc. and thus wearing their contact portions. Heat generated by wear exerts adverse effects on the life of the piezoelectric vibrator 4, which is also considered as a reason for stopping the apparatus. It may further be considered that because the transmission of this vibration is a planar transmission with a constant cross section, slight tolerance, etc. of mechanical mounting portions generates difference in the transmission of vibration to the melt, resulting in unevenness in the quality of fine metal balls among production lots.

The speed of the melt ejected through the orifices 2 is determined by difference between the pressure of the melt 1 exerting on the vicinity of the orifices 2 in the crucible 3 and a gas pressure in a solidification chamber (not shown), etc. The pressure of the melt 1 exerting on the vicinity of the orifices 2 in the crucible 3 decreases in proportion to the amount of the melt in the crucible 3, which decreases as the melt 1 is ejected. On the other hand, the gas pressure in the solidification chamber increases in proportion to a temperature inside the solidification chamber, which is elevated by the quantity of heat and heat of solidification of the melt ejected. Thus, the difference in pressure between the crucible 3 and the solidification chamber decreases as the ejection of the melt into the solidification chamber proceeds, resulting in change in the cooling speed of the melt droplets 9 accordingly. It is thus considered that there arises unevenness in the solidification structure of the fine metal balls produced.

OBJECT OF THE INVENTION

Accordingly, an object of the present invention is to provide an apparatus for stably producing fine metal balls having a narrow particle size distribution and a high sphericity by a uniform droplet spray method.

Another object of the present invention is to provide an apparatus for producing fine metal balls, wherein the ejection speed of the melt is easily kept constant.

A further object of the present invention is to provide an apparatus for producing fine metal balls having a homogeneous solidification structure, wherein a gas pressure in a solidification chamber can easily be controlled.

DISCLOSURE OF THE INVENTION

The apparatus for producing fine metal balls according to the present invention comprises a crucible for holding a metal melt and equipped with orifices for ejecting the metal melt; a vibration rod for giving vibration to the melt held in the crucible; a vibrator for giving vibration to the vibration rod; a means for transmitting the vibration of the vibrator to the vibration rod; and a chamber in which melt droplets ejected through the orifices are solidified while dropping, the vibration-transmitting means having one end in contact with the vibrator and the other end abutting a support member connected to the vibration rod; the vibration-transmitting means having a cross section decreasing as it nears the support member. The vibration-transmitting means preferably has a tip end portion substantially in a hemispherical or half-cylindrical shape.

In one embodiment of the present invention, the solidification chamber comprises a means for bounding the solidified fine metal balls a plurality of times so that the kinetic energy of the fine metal balls is attenuated by a plurality of steps. Specifically, the solidification chamber comprises a slanting surface member at a position at which the fine metal balls land, and an inner surface of the solidification chamber and the slanting surface member are covered with shock-absorbing means such as rubber, such that the fine metal balls are caused to bound a plurality of times between both shock-absorbing means.

In another embodiment of the present invention, the apparatus for producing fine metal balls comprises (a) a melt-ejecting means comprising a melt-ejecting crucible for holding a metal melt and equipped with orifices for ejecting the metal melt, a pressure-controlling means for controlling the pressure of the melt ejected through the orifices, and a vibration means for giving vibration to the melt; (b) a melt supplier comprising one or more melt supply crucibles for holding the melt, and one or more conduits connecting the melt supply crucibles to the melt-ejecting crucible; and (c) a solidification chamber in which melt droplets ejected through the orifices are solidified while dropping. The melt supply crucible is preferably equipped with a metal material-supplying means.

The vibration means in this embodiment comprises a vibration rod for giving vibration to the melt held in the melt-ejecting crucible, a vibrator for giving vibration to the vibration rod, and a means for transmitting the vibration of the vibrator to the vibration rod, the vibration-transmitting means having one end in contact with the vibrator and the other end abutting a support member connected to the vibration rod, and the vibration-transmitting means having a cross section decreasing as it nears the support member.

The melt supply crucible is preferably equipped with an elevating means for changing the height thereof. Each of the melt-ejecting crucible and the melt supply crucible is equipped with a gas-pressure controlling means for controlling a gas pressure applied to a surface of the melt held therein. Using an inert gas or a reducing gas for gas pressure control, the oxidation of the melt can be prevented.

The melt supply crucible can be equipped with a means for detecting the surface position of the meld held therein or a load cell for detecting the change of the weight of the melt, to determine the weight of the melt ejected from the melt-ejecting crucible.

In a further embodiment of the present invention, the apparatus for producing fine metal balls comprises a melt-ejecting means comprising a crucible for holding a metal melt and equipped with orifices for ejecting the metal melt, and a vibration means for giving vibration to the melt; a solidification chamber in which melt droplets ejected through the orifices are solidified while dropping; and a heat-exchanging means for controlling the temperature of an atmosphere inside the solidification chamber. The heat-exchanging means preferably comprises a heat-exchanging portion mounted onto an inner wall of the solidification chamber, a coolant circulating in the heat-exchanging portion, and a temperature controller for controlling the temperature of the coolant.

The vibration means in this embodiment comprises a vibration rod for giving vibration to the melt held in the crucible, a vibrator for giving vibration to the vibration rod, and a means for transmitting the vibration of the vibrator to the vibration rod, the vibration-transmitting means having one end in contact with the vibrator and the other end abutting a support member connected to the vibration rod, and the vibration-transmitting means having a cross section decreasing as it nears the support member.

The heat-exchanging means preferably comprises a sub-chamber connected to the solidification chamber such that a gas can be circulated therebetween, a heat-exchanging portion mounted in the sub-chamber, a coolant circulating in the heat-exchanging portion, and a temperature controller for controlling the temperature of the coolant. The temperature controller preferably controls the temperature of the coolant based on the gas temperature detected by a thermometer mounted in the solidification chamber.

BRIEF DESCRIPTION OF THE DRAWINGS

FIG. 2(*b*) is an enlarged perspective view showing a vibration-transmitting means and a support member in an apparatus for producing fine metal balls according to a further embodiment of the present invention;

FIG. 10(*b*) is a graph showing sphericity distributions of solder balls produced in EXAMPLES 1 and 2;

FIG. 11(*b*) is a graph showing sphericity distributions of solder balls produced in COMPARATIVE EXAMPLES 1 and 2.

DETAILED DESCRIPTION OF THE PREFERRED EMBODIMENTS

Figure 1:
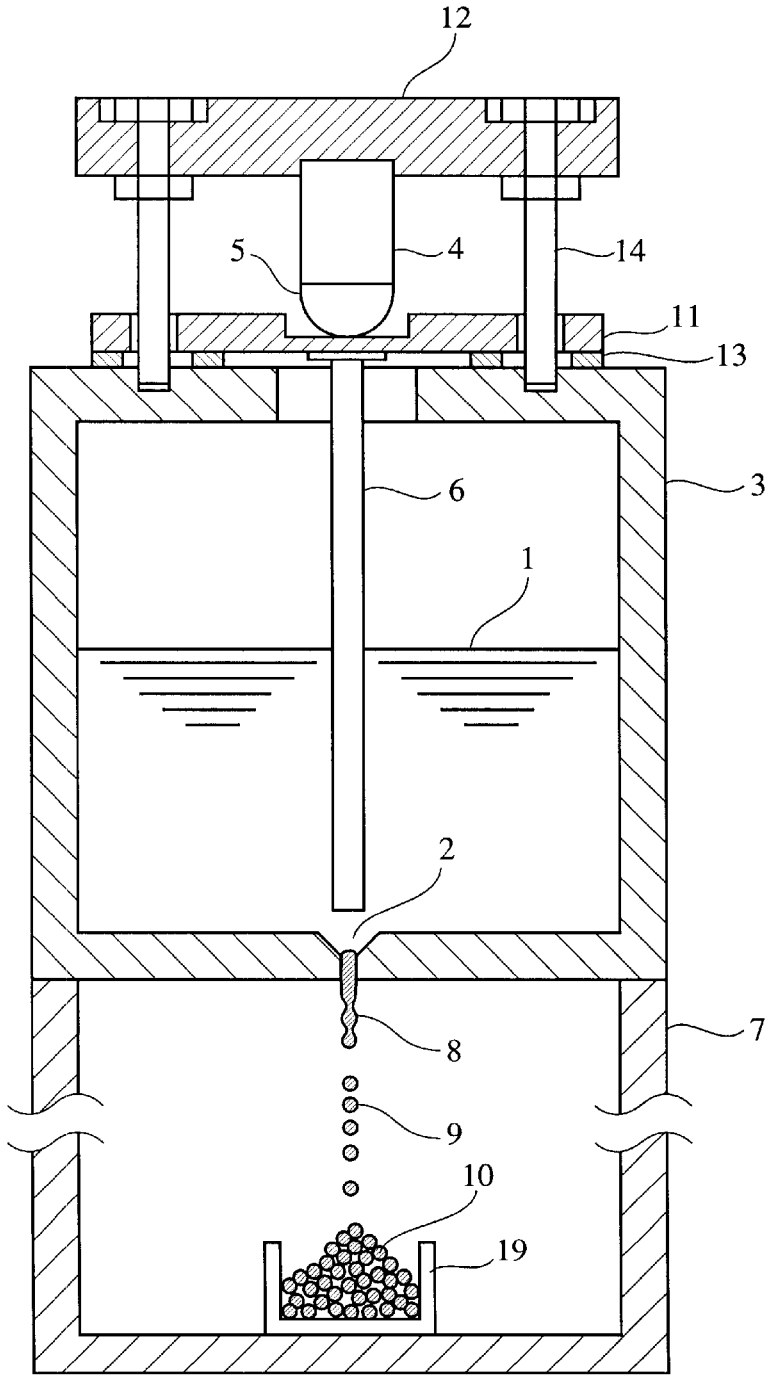
FIG. 1 is a schematic cross-sectional view showing an apparatus for producing fine metal balls according to one embodiment of the present invention.

FIG. 1 shows the apparatus for producing fine metal balls according to one embodiment of the present invention. This apparatus comprises a crucible 3 having orifices 2 at the bottom and an opening at the top for holding a metal melt 1, a melt vibration means, and a solidification chamber 7 disposed directly under the crucible 3 in an airtight manner. The melt vibration means comprises a vibrator 4 disposed above the opening of the crucible 3, a vibration-transmitting means 5 connected to a lower end of the vibrator 4, a support member 11 having an upper surface in contact with the vibration-transmitting means 5 at a center and a lower surface mounted onto an upper surface of the crucible 3, and a vibration rod 6 mounted to a lower surface of the support member 11 and immersed in the melt 1.

The vibration of the vibrator 4 is transmitted to the vibration rod 6 via the vibration-transmitting means 5 and the support member 11, and the vibration rod 6 gives vibration to the melt 1. The pressure in the crucible 3 is set higher than that in the solidification chamber 7. Because of this difference in pressure, the melt 1 is ejected through the orifices 2 into the solidification chamber when vibration is given. It should be noted that the orifices 2 are always open, because the melt 1 does not leak by surface tension when there is no vibration.

An ejected continuous melt column 8 gradually changes its shape, resulting in separate melt droplets 9 falling in the solidification chamber 7. The melt droplets 9 are gradually made spherical and solidified while dropping with their heat given to a gas inside the solidification chamber 7. The solidified fine metal balls 10 are deposited in a collector container 19 disposed on the bottom of the solidification chamber.

The melt ejected from the crucible 3 through the orifices 2 into the solidification chamber 7 is in different shapes depending on the ejection speed. Specifically, it becomes melt droplets dropping from the orifices 2 intermittently at slow ejection, melt droplets scattering around from the orifices 2 at high-speed ejection, and continuous melt columns flowing from the orifices 2 at middle-speed ejection. Among these three shapes, the uniform droplet spray method necessitates that the melt ejected through the orifices 2 is in a continuous column shape. An ejection speed range in which the melt column is formed is determined by the diameter of each orifice 2, and the surface tension and density of the melt.

The melt falling in a continuous column shape is cut at its lower end portion by its own weight, resulting in separate melt droplets 9. In the uniform droplet spray method, melt droplets of uniform particle size can be obtained by cutting the continuous melt column at a constant interval. For this purpose, it is necessary that the melt falling in a column shape be forcibly vibrated at a constant frequency from outside. In practice, the melt 1 in the crucible is forcibly vibrated at a constant frequency, and this vibration is transmitted to the continuous melt column, such that the continuous melt column is vibrated at a constant frequency.

By vibrating the continuous melt column at a number of vibration called the maximum unstable frequency in a nonviscous fluid in the research of Rayleigh, uniform melt droplets can be formed. Small initial disturbance in the melt column grows as the time passes, and when the amplitude of disturbance exceeds a radium of the continuous melt column 8, the melt is cut to separate melt droplets 9 depending on the amplitude of disturbance. The resultant melt droplets 9 gradually became spherical and were solidified to fine metal balls 10 of uniform particle size by giving its heat to a gas in the solidification chamber in the course of dropping.

(A) Crucible

The crucible 3 may be protected from the outside air by a crucible-holding member (not shown). The atmosphere in the crucible 3 and the crucible-holding member may be an inert gas or a mixture of an inert gas and a small amount (for instance, about 8 volume %) of a hydrogen gas to prevent the oxidation of the melt 1. The gas pressure in the crucible 3 should be higher than pressure in the solidification chamber 7 to eject the melt 1 through orifices 2. Specifically, it is preferable to pressurize the melt 1 about 0.005–0.35 MPa higher than the atmosphere gas pressure in the solidification chamber 7. By the surface tension of the melt 1, the melt 1 does not leak through the orifices 2 when there is no vibration.

Electric charge may be added to the melt column 8 or the melt droplets 9 by a charging means (not shown). Because the charged melt droplets are repulsive to each other, their merger can effectively be prevented. Accordingly, the melt droplets remain separate, keeping their original particle sizes. Incidentally, electric charge may be given to the melt 1. When electric repulsion is utilized with a charging means, separate melt droplets can strongly be prevented from being merged. Therefore, when each of orifices is combined with a charging portion and a collecting portion, the productivity of fine metal balls can be remarkably increased.

(B) Vibration Means

The piezoelectric vibrator 4 is supported by a holding member 12 fixed to the crucible 3 or a crucible-holding member (not shown) with bolts 14, and a hemispherical tip end portion of the vibration-transmitting means 5 fixed to a tip end portion of the piezoelectric vibrator 4 abuts the support member 11. The support member 11 is fixed to the crucible 3 or a crucible-holding member (not shown) via an elastic member 13 such as rubber, such that the vertical vibration is efficiently transmitted to the vibration rod 6.

The piezoelectric vibrator 4 is used because it can generally have a high resonance frequency from the aspect of generating high frequency, resulting in the efficient production of fine metal balls. The piezoelectric vibrator 4 is preferably a laminate-type piezoelectric vibrator, because even a small one can generate large vibration. Because the piezoelectric vibrator loses piezoelectric characteristics when it is subjected to such a high temperature as about 370 K, it should be enough separated from the crucible or cooled to reduce influence of heat dissipation from the crucible. When a sinusoidal or rectangular wave at a predetermined frequency generated by a function generator and amplified by a power amplifier is applied to the piezoelectric vibrator 4, the piezoelectric element 4 generates vibration at predetermined frequency and amplitude.

The vibration-transmitting means 5 has a tip end portion having a cross section decreasing as it nears the support member 11. As specific examples, the tip end portion of the vibration-transmitting means 5 may be in a shape of a hemisphere, a cone having a curved surface at an apex thereof, a cone having a side surface of second degree, etc. In the embodiment shown in FIG. 1, the vibration-transmitting means 5 is in a hemispherical shape, abutting the support member 11 at one point. Also, as shown in FIGS. 2(*a*) and (*b*), the vibration-transmitting means 5 may be in a half-cylindrical shape, such that it is brought into linear contact with the support member 11.

Figure 2:
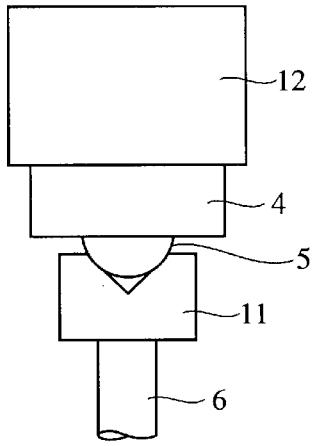
FIG. 2(*a*) is an enlarged side view showing a vibration-transmitting means and a support member in an apparatus for producing fine metal balls according to another embodiment of the present invention.
Figure 2:
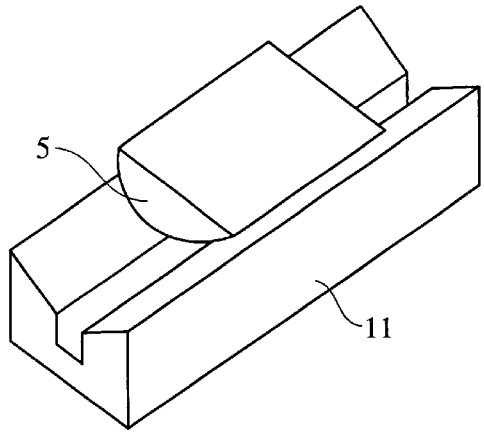

For instance, as shown in FIG. 2(*b*), even when the vibration direction of the vibrator 4 is not completely aligned with the center axis of the vibration rod 6 by mounting errors of the vibration means, the vibration-transmitting means 5 abuts the support member 11, so that the vibration of the piezoelectric vibrator 4 is automatically corrected in the center axis direction of the vibration rod 6 and transmitted thereto. In an embodiment shown in FIG. 2(*b*), a V-shaped bottom surface of the support member 11 is provided with a groove to make an automatic correction function effective. Though the vibration-transmitting means 5 is in contact with or connected to the vibrator 4, contact or connection surfaces thereof may have circular, rectangular or any other shapes.

The support member 11 is mounted onto the crucible 3 (or crucible-holding member not shown) via an elastic member 13. The elastic member 13 functions to keep the crucible 3 airtight and attenuate the vibration of the piezoelectric vibrator 4 that is transmitted to the crucible 3.

In an embodiment shown in FIG. 1, the vibration rod 6 has a circular cross section. Because a cylindrical rod 6 has a uniform vibration mode, vibration is uniformly transmitted to the melt 1. The vibration rod 6 may have a cross section other than a circle, for instance, a rectangular cross section, if necessary. Materials for the vibration rod 6 may be those not reactive to the melt 1, usually stainless steel. The use of ceramics such as silicon nitride, aluminum nitride, etc. is advantageous in that the vibration rod 6 has a high resonance point, enabling the high-frequency vibration of the vibrator 4 to be transmitted efficiently, and that it has a reduced inertia moment because of a low specific density, resulting in large amplitude.

(C) Solidification Chamber

The atmosphere gas in the solidification chamber 7 is preferably an inert gas such as a nitrogen gas, or a mixture of an inert gas and about 8 volume % of a hydrogen gas. When a hydrogen gas is used, moisture and oxygen, impurities in the inert gas, can be collected. Moisture and oxygen are preferably as little as possible while the melt is solidified, because they oxidize surfaces of the fine metal balls. Also, a hydrogen gas is effective to prevent the oxidation of the fine metal balls because of its reducing power.

It is important to determine the atmosphere pressure in the solidification chamber 7 depending on such conditions as the diameter of an orifice, the surface tension of melt droplets, etc., such that the ejected melt stably forms a columnar stream. Specifically, the atmosphere pressure in the solidification chamber 7 is preferably kept at a constant pressure of 0.01–0.3 MPa by gauge. When it is less than 0.01 MPa, the pressure of the solidification chamber relative to the outside is insufficient. On the other hand, when it exceeds 0.3 MPa, the safety design of the solidification chamber 7 as a pressure container becomes costly. The pressure in the solidification chamber 7 is more preferably 0.02–0.25 MPa, further preferably 0.05–0.2 MPa. Because the solidification chamber 7 is pressurized to 0.01–0.3 MPa, the solidification speed of the melt can be increased, resulting in decrease in the height of the solidification chamber.

Figure 3:
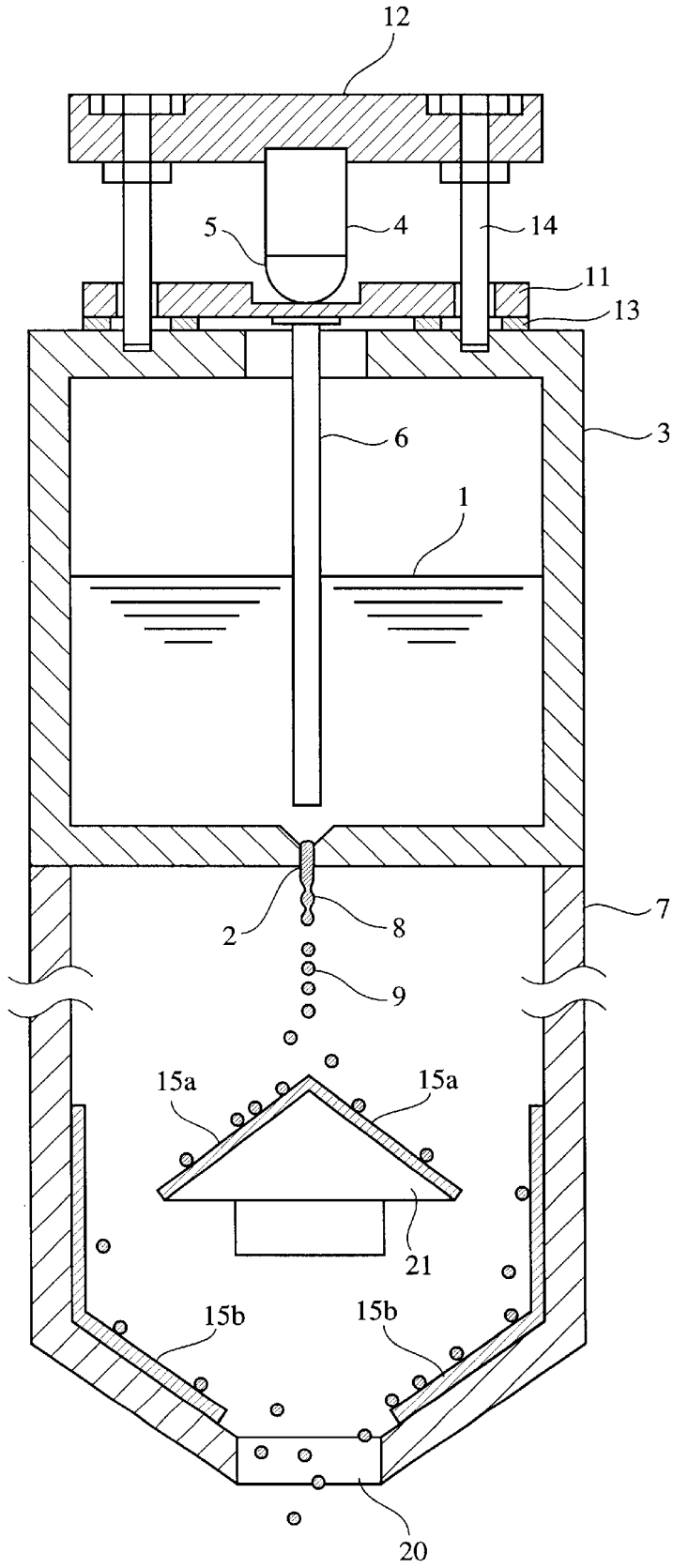
FIG. 3 is a schematic cross-sectional view showing an apparatus for producing fine metal balls according to a still further embodiment of the present invention.

FIG. 3 shows an apparatus for producing fine metal balls according to another embodiment of the present invention. This apparatus comprises a conical member 21 having a slanting surface disposed under the orifices 2 with a certain distance, and shock absorbers 15*a*, 15*b* made of rubber mounted onto the slanting surface and an inner surface of the solidification chamber. After the fine metal balls 9 land the shock absorber 15*a*, they repeatedly bound between the shock absorbers 15*a*, 15*b*, so that the kinetic energy of the fine metal balls 9 is attenuated by a plurality of steps. This prevents the fine metal balls 9 from being deformed or damaged by impact. The fine metal balls 9 are collected through a collecting exit 20 at the bottom of the solidification chamber 7.

Figure 4:
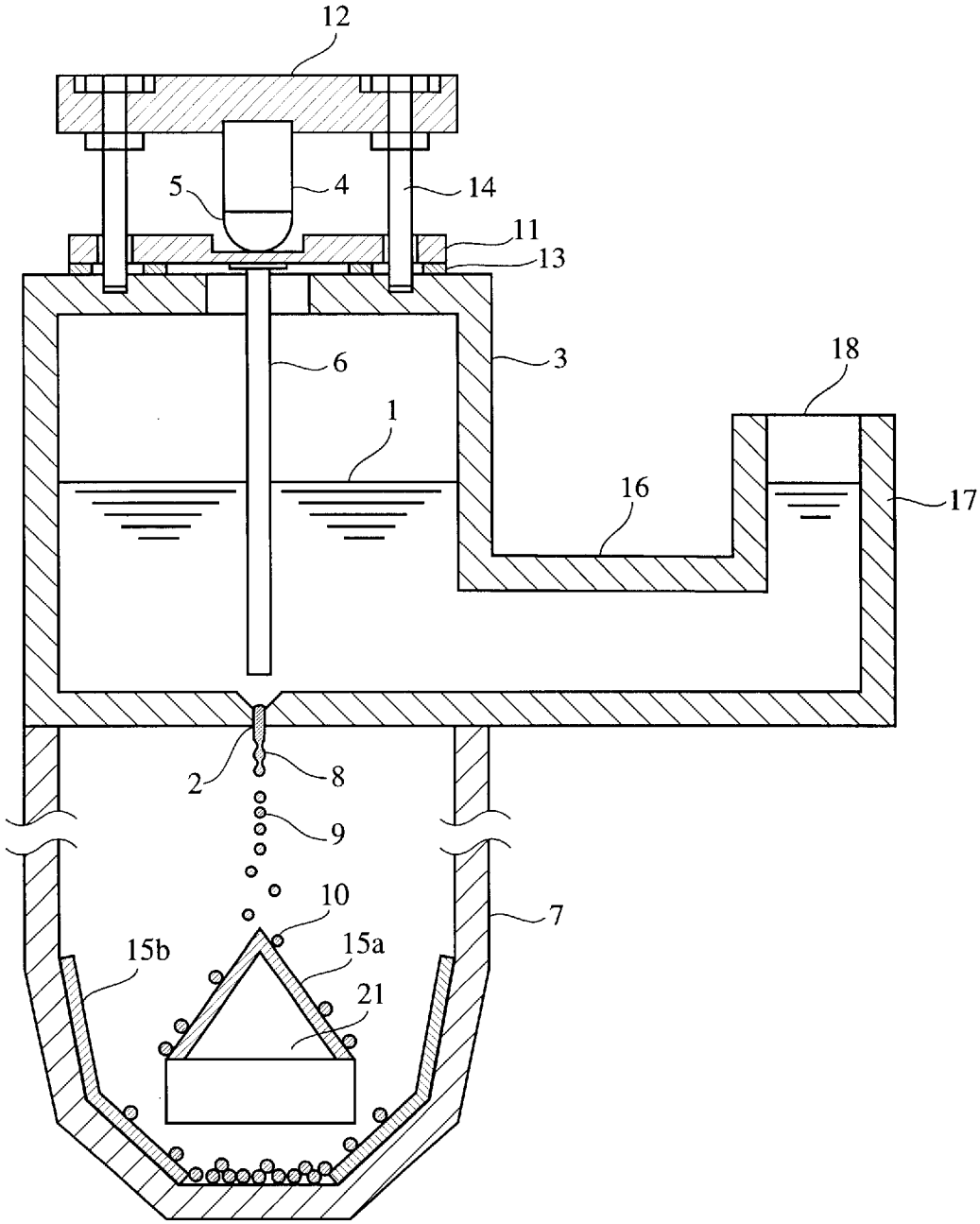
FIG. 4 is a schematic cross-sectional view showing an apparatus for producing fine metal balls according to a still further embodiment of the present invention.

FIG. 4 shows an apparatus for producing fine metal balls according to a further embodiment of the present invention. The crucible 3 in this apparatus comprises a lateral extension 16 extending from a lower part of the crucible 3, a vertical portion 17 mounted to a tip end of the extension 16, and an opening 18 disposed at an upper end of the vertical portion 17. With the vertical portion 17 used as a melt supplier, the body portion of the crucible 3 can function as a melt-ejecting crucible 3. This crucible 3 is suitable in a case where the oxidation of the melt 1 does not pose any problems.

Figure 5:
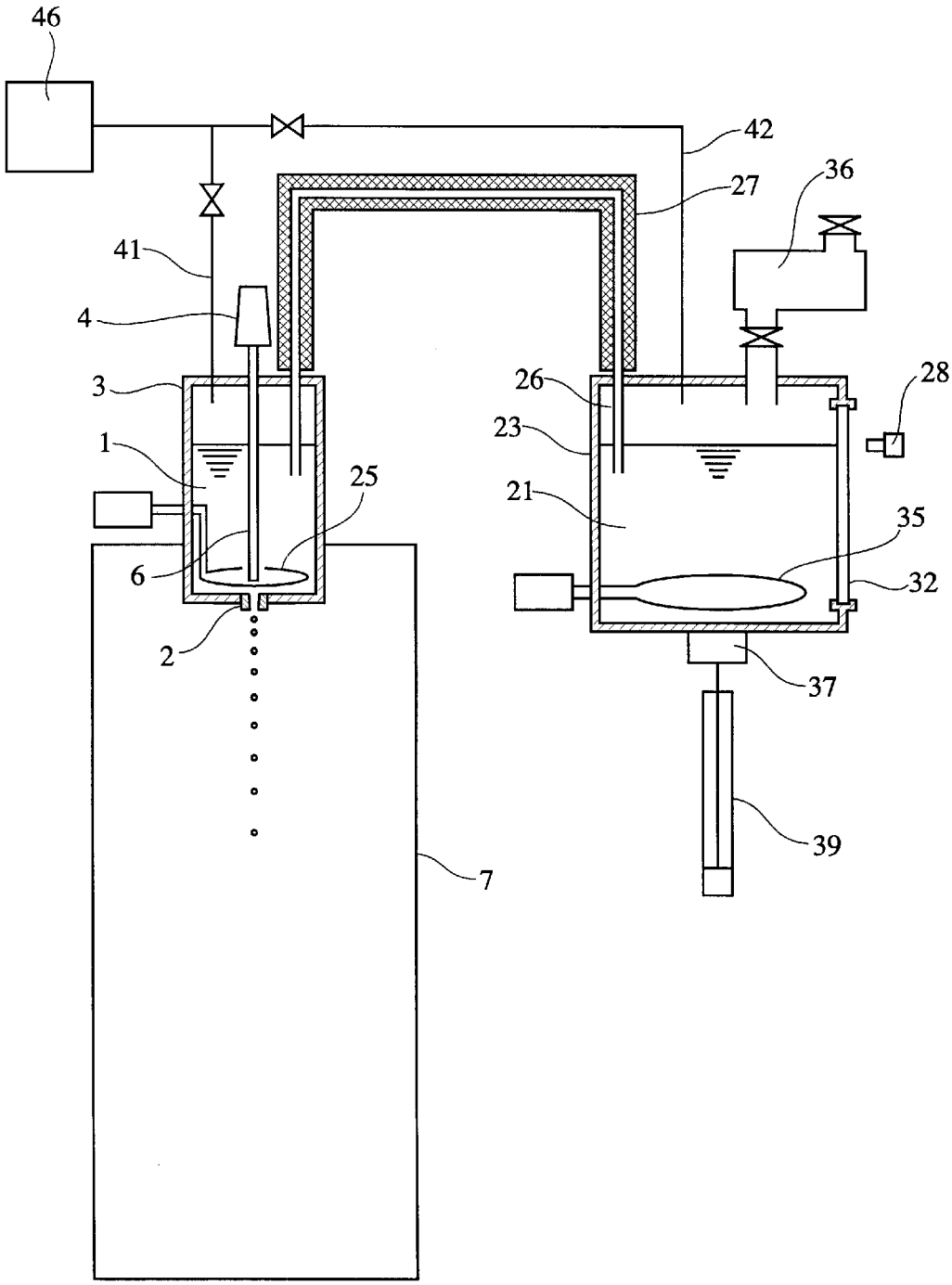
FIG. 5 is a schematic cross-sectional view showing an apparatus for producing fine metal balls according to a still further embodiment of the present invention.

FIG. 5 shows an apparatus for producing fine metal balls according to a still further embodiment of the present invention. This apparatus comprises a melt supply crucible 23 connected to a melt-ejecting crucible 3, a conduit 26 connecting the melt supply crucible 3 to the melt-ejecting crucible 23, an elevating means 39 for moving the melt supply crucible 23 vertically, and a load cell 37 mounted between a lower surface of the melt supply crucible 23 and a tip end of the elevating means 39. The melt-ejecting crucible 3 is equipped with a vibration rod 6 connected to the vibration-generating means 4, and the melt supply crucible 23 is equipped with a metal supply means 36 that enables continuous ejection of the melt for a long period of time. Pipes 41, 42 connected to a pressure-controlling means 46 are open in both of the melt-ejecting crucible 3 and the melt supply crucible 23.

After a metal melt is charged to both crucibles 3, 23, pressure difference is generated by the pressure-controlling means 46 between the melt-ejecting crucible 3 and the melt supply crucible 23, to fill the conduit 26 with the melt. After the conduit 26 is filled with the melt, the gas pressure in the melt-ejecting crucible 3 is made equal to that in the melt supply crucible 23 by the pressure-controlling means 46, such that the melt becomes movable through the conduit 26 therebetween, resulting in the same height of a melt surface position between both crucibles 3, 23. That is, the conduit 26 functions as a siphon. The amount of the melt 1 can thus be kept constant in the melt-ejecting crucible 3, resulting in the uniform ejection of the melt through the orifices 2. As a result, fine metal balls of uniform particle size can be produced for a long period of time.

When the vibration-generating means 4 is driven to generate vibration, which is given to the melt 1 near the orifices 2 via the vibration rod 6, thereby increasing pressure applied to both crucibles 3, 23, the melt is ejected through the orifices 2 into the solidification chamber 7 to form fine metal balls of uniform particle size. It should be noted that though FIG. 5 omits the detailed structures of the vibration-generating means 4 and the vibration rod 6, they may have the same structures as those shown in FIG. 1.

As the melt is ejected, a melt surface position in the melt-ejecting crucible 3 is lowered, leading to the lowering of a melt surface position in the melt supply crucible 23. As the melt surface position is lowered, pressure applied to the orifices 2 decreases, resulting in decrease in the ejection speed of the melt 1. Though it may be possible to further pressurize the crucible 3 to prevent this decrease, it is difficult to carry out such control that the flow rate of a gas is adjusted to continuously increase pressure in the crucible 3 in accordance with decrease in the melt in the crucible 3. Accordingly in this embodiment, with the pressure in the melt-ejecting crucible 3 and the melt supply crucible 23 kept constant, the change of a surface position of the melt 21 in the melt supply crucible 23 is measured by a melt surface position-measuring apparatus 28, and the melt supply crucible 23 is moved vertically by the elevating means 39, such that the surface position of the melt 21 is always constant relative to the orifices 2.

When the melt supply crucible 23 is elevated, the melt flows from the melt supply crucible 23 into the melt-ejecting crucible 3 via the conduit 26 in an amount equal to that of a melt ejected through the orifices 2. As a result, the surface position of the melt 1 in the melt-ejecting crucible 3 can be kept constant, resulting in a constant ejection speed of the melt and thus fine metal balls of uniform particle size.

The measurement of the melt surface position can be carried out by a melt surface position-measuring apparatus 28 such as a laser measurement apparatus, etc. via a transparent glass window 32 mounted in a sidewall of the melt supply crucible 23. Though measurement can be carried out in the melt-ejecting crucible 3, it is preferable to conduct the measurement in the melt supply crucible 23 because a measurement apparatus can be easily set. When a transparent glass window 32 cannot be disposed in the melt supply crucible 23, a load cell 37 may be mounted onto a lower part of the melt supply crucible 23 to continuously measure change in the weight of the melt supply crucible 23.

The melt-ejecting crucible 3 and the melt supply crucible 23 are preferably equipped with heaters 25, 35 capable of controlling the melting or melt temperatures of metal materials. With this, a temperature-controlled melt can be supplied to the melt-ejecting crucible 3. Also, to prevent the temperature decrease of the melt during conveyance, the conduit 26 is preferably covered by a heat insulator 27. Also, by using temperature-controllable heater 35, it is possible to carry out temperature compensation from the beginning.

Figure 6:
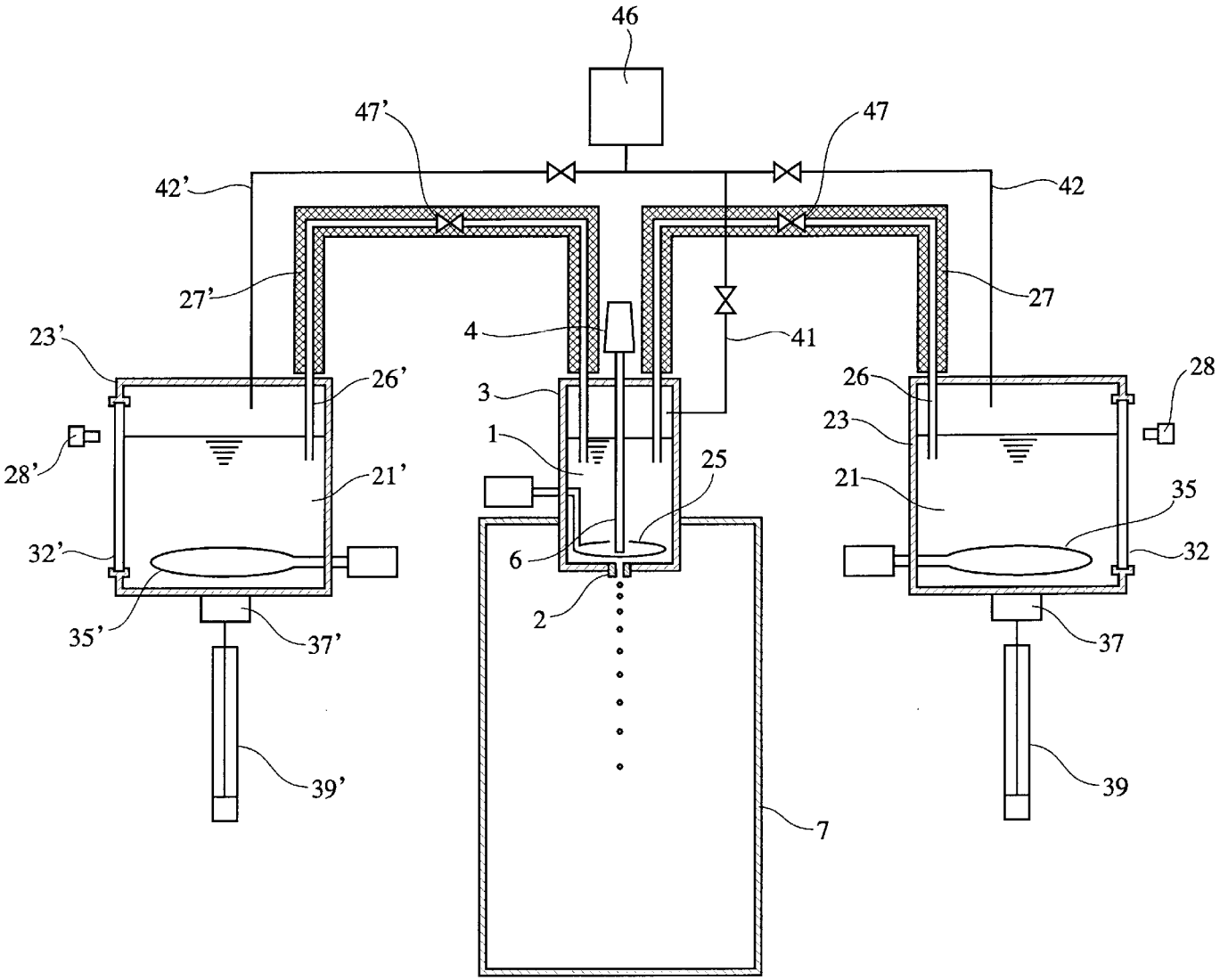
FIG. 6 is a schematic cross-sectional view showing an apparatus for producing fine metal balls according to a still further embodiment of the present invention.

As shown in FIG. 6, two or more melt supply crucibles 23, 23' disposed to one melt-ejecting crucible 3 enables the continuous ejection of a melt for a long period of time. Though the number of the melt supply crucibles 23, 23' may be increased to elongate a melt ejection period, an on-off valve 47, 47' may be mounted to each conduit 26, 26'. Though FIG. 6 omits the detailed structures of the vibration-generating means 4 and the vibration rod 6, they may have the same structures as those shown in FIG. 1.

While the on-off valve 47 is opened to supply a melt from the melt supply crucible 23 to the melt-ejecting crucible 3, the on-off valve 47' is closed, so that a metal material is melted in another melt supply crucible 23'. Also, before the melt supply crucible 23 becomes empty, the on-off valve 47 is closed and the on-off valve 47' is opened to supply a melt to the melt-ejecting crucible 3. By repeating this operation, a melt can be continuously supplied to the melt-ejecting crucible 3.

With such a design that the melt supply crucible 23 has a larger capacity than the melt-ejecting crucible 3, it is possible to reduce influence of vibration and increase in the amount of a melt, which are caused at the time of charging a metal material into the melt 21 in the melt supply crucible 23, on the pressure near the orifices 2.

Figure 7:
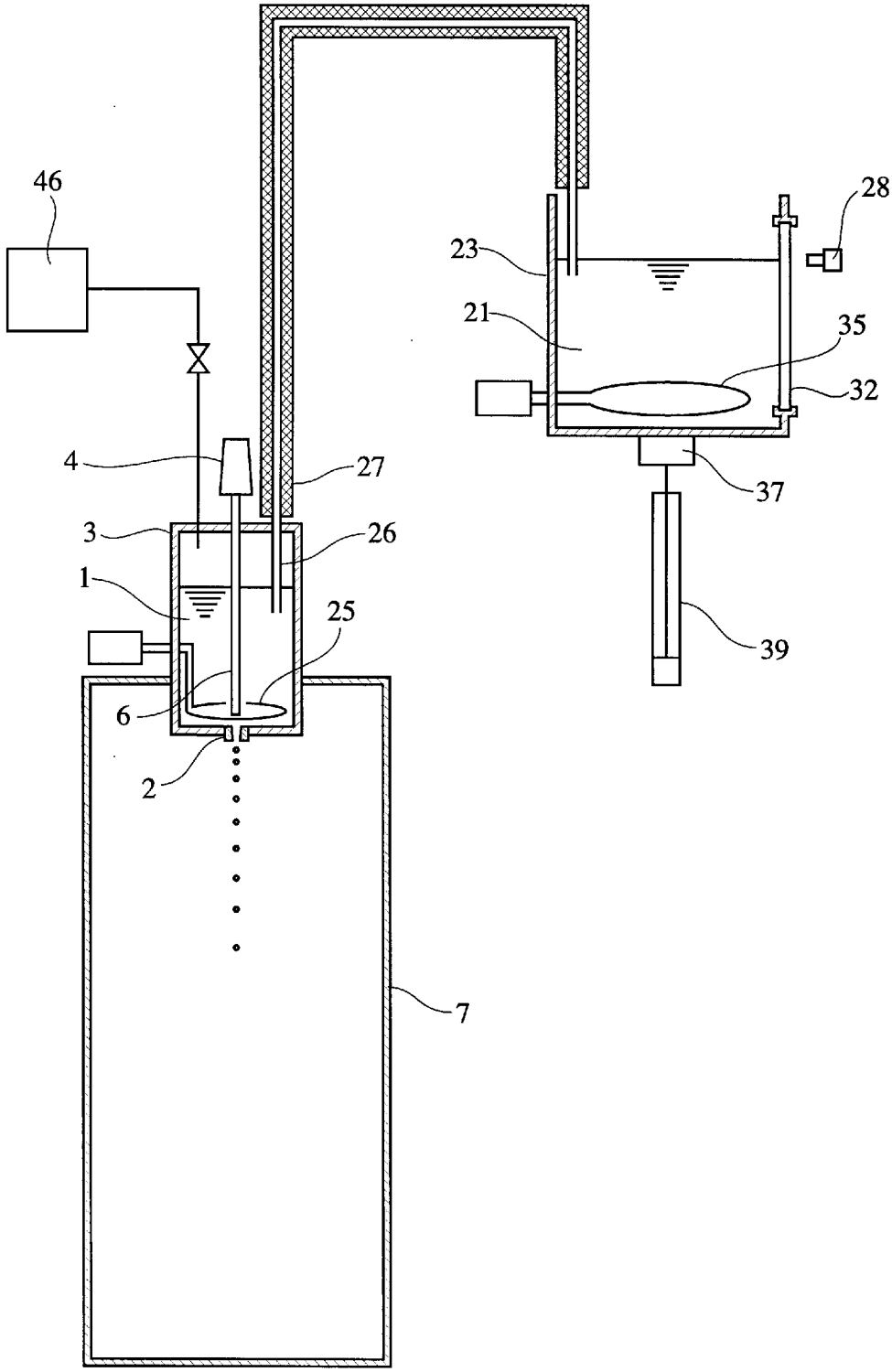
FIG. 7 is a schematic cross-sectional view showing an apparatus for producing fine metal balls according to a still further embodiment of the present invention.

When the oxidation of the melt does not pose problems, only a melt supply crucible 23 may be open to the air as shown in FIG. 7. With this structure, the supply of a metal material and the measurement of a melt surface position can easily be conducted. When the melt surface becomes too low in the melt-ejecting crucible 3 by opening the melt supply crucible 23 to the air, it is preferable to dispose the melt supply crucible 23 at a higher position than the melt-ejecting crucible 3. Though FIG. 7 omits the detailed structures of the vibration-generating means 4 and the vibration rod 6, they may have the same structures as those shown in FIG. 1.

As long as the supply of a melt from the melt supplier is balanced with the ejection of the melt through the orifices 2, the fine metal balls can be produced continuously. The supply of a melt should be conducted without causing disturbance in the melt 1 in the crucible 3. Accordingly, as long as this condition is met, a metal material may be supplied in the form of an ingot through a material inlet, or a melt prepared in another crucible may be supplied.

Figure 8:
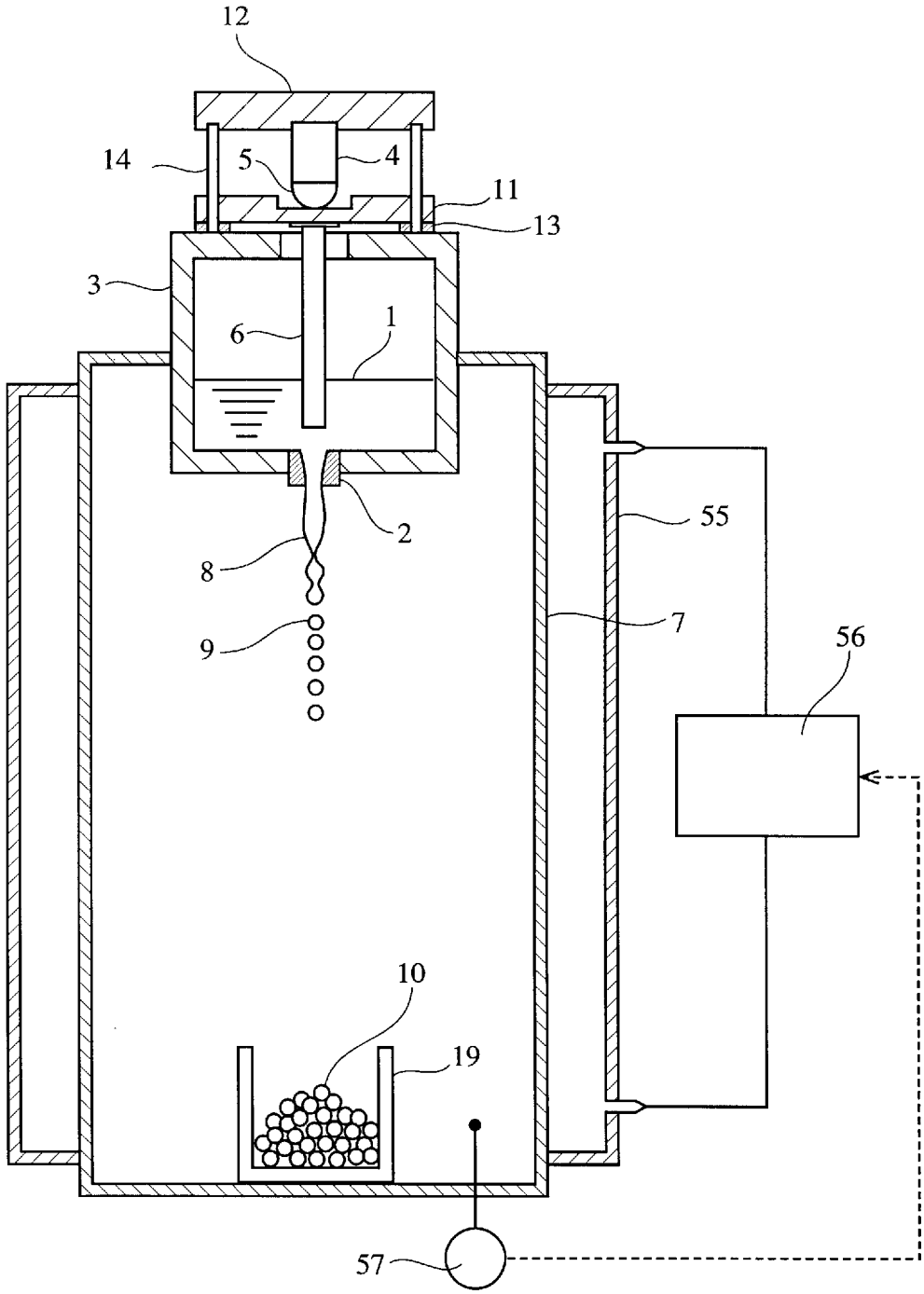
FIG. 8 is a schematic cross-sectional view showing an apparatus for producing fine metal balls according to a still further embodiment of the present invention.

FIG. 8 shows an apparatus for producing fine metal balls according to a still further embodiment of the present invention. The solidification chamber 7 is equipped on a chamber wall with a cooling jacket 55, in which a coolant such as liquid nitrogen is circulated to control a temperature in the solidification chamber 7. Heat absorbed by a gas in the solidification chamber 7 from the melt droplets 9 is discharged outside via the coolant, thereby suppressing the temperature elevation in the solidification chamber 7. Because the pressure increase in the solidification chamber 7 is thus suppressed, the ejection speed of the melt through the orifices 2 can be maintained constant, resulting in the formation of uniform melt droplets 9.

To keep the temperature in the solidification chamber 7 precisely constant, the temperature in the solidification chamber 7 is measured by a temperature sensor 57, and a temperature-controlling means 56 having a heat exchange function discharges the heat of the coolant circulating in the cooling jacket 55 outside based on the measured temperature, to carry out temperature control.

Figure 9:
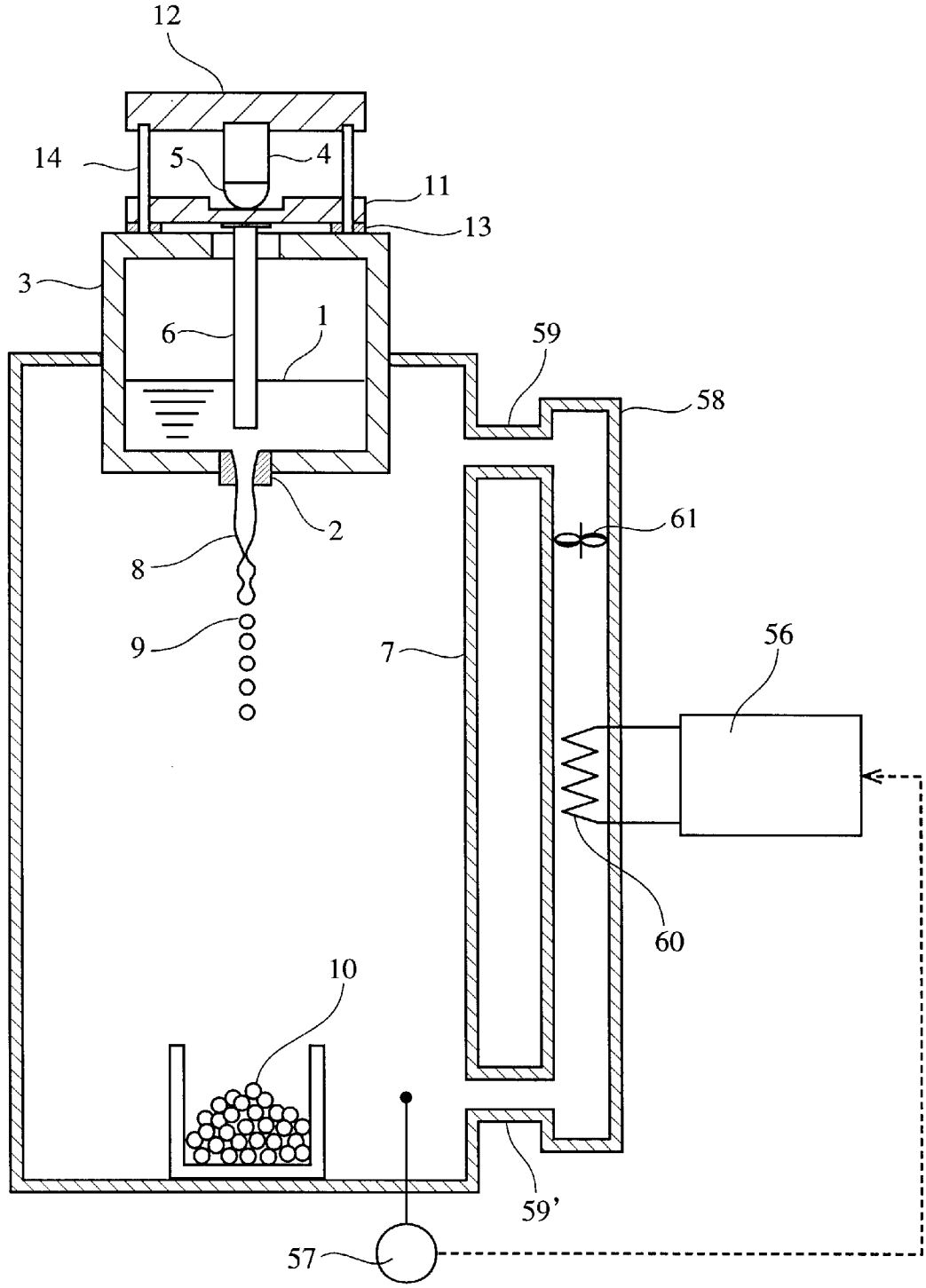
FIG. 9 is a schematic cross-sectional view showing an apparatus for producing fine metal balls according to a still further embodiment of the present invention.

The apparatus for producing fine metal balls shown in FIG. 9 comprises a sub-chamber 58 communicating with the solidification chamber 7 via upper and lower ports 59, 59'. A gas heated with the solidification of the ejected melt in the solidification chamber 7 is introduced into the sub-chamber 58 via a port 59 located in an upper portion of the solidification chamber 7. The gas introduced into the sub-chamber 58 is heat-exchanged with the coolant in the heat-exchanging portion 60. The temperature-controlled gas is returned to the solidification chamber 7 via a port 59' located in a lower portion of the solidification chamber 7. In this instance, the gas temperature is measured by a temperature sensor 57 disposed in a lower portion of the solidification chamber 7, and the temperature of the coolant is controlled by the temperature-controlling means 56 lest that the measured value exceeds the predetermined gas temperature. This makes it possible to indirectly control the temperature in the solidification chamber 7. The indirect control of temperature in the solidification chamber 7 can provide more uniform gas temperature distribution in a horizontal direction in the solidification chamber 7 than the direct control of temperature in the solidification chamber 7.

In the apparatus shown in FIG. 9, the circulation of a gas between the solidification chamber 7 and the sub-chamber 58 may be carried out arbitrarily by a spontaneous circulation system utilizing a gas temperature difference, or a circulation system forced by a fan 61, depending on the predetermined conditions of fine metal balls. Though a gas is circulated upward in the solidification chamber 7 in the embodiment shown in FIG. 9, a gas can be circulated downward by the forced circulation system.

The heat-exchanging means can keep a gas pressure constant, thereby achieving a constant ejection speed of the melt. Because a temperature for cooling the ejected melt droplets is kept constant, the solidification structure of the resultant fine metal balls can be made homogeneous. By adjusting the temperature in the solidification chamber by the heat-exchanging means before ejection, the cooling speed can be controlled to a desired level from the beginning of ejection.

The present invention will be explained in further detail by way of the following Examples without intention of restricting the scope of the present invention.

Example 1

Using the apparatus for producing fine metal balls shown in FIG. 1, solder balls having a composition of 63Sn-Pb by mass % (average diameter: about 350 μm) were produced under the following conditions. Incidentally, a melt 1 was charged by a charging means (not shown).

Atmosphere in crucible: Nitrogen gas of 1.2 MPa,

Vibrator: Laminate-type piezoelectric element (available from Hitachi Metals, maximum displacement of 15 μm and frequency characteristics of 1.8 MHz), Atmosphere in solidification chamber: Mixed gas of 8 volume % hydrogen and nitrogen, and Temperature in solidification chamber: 3–5° C.; liquid nitrogen was caused to flow through a spiral cooling pipe disposed around a path through which melt droplets dropped.

Figure 10:
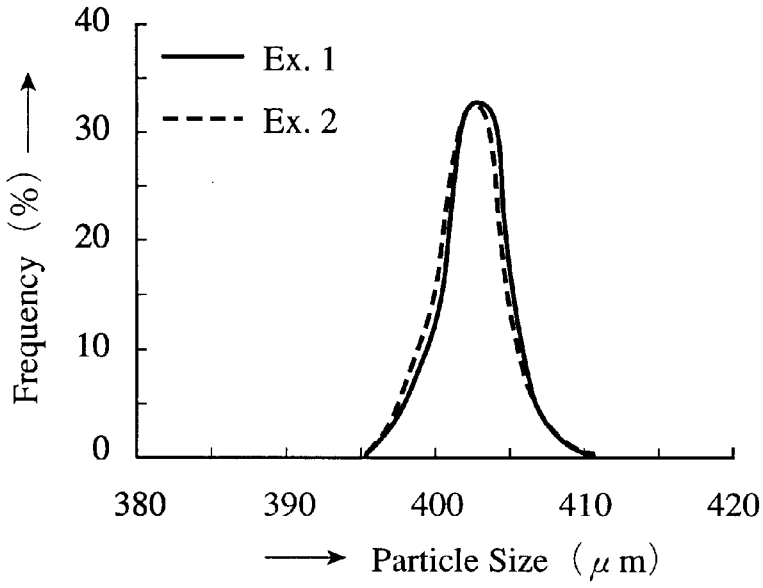
FIG. 10(*a*) is a graph showing particle size distributions of solder balls produced in EXAMPLES 1 and 2.
Figure 10:
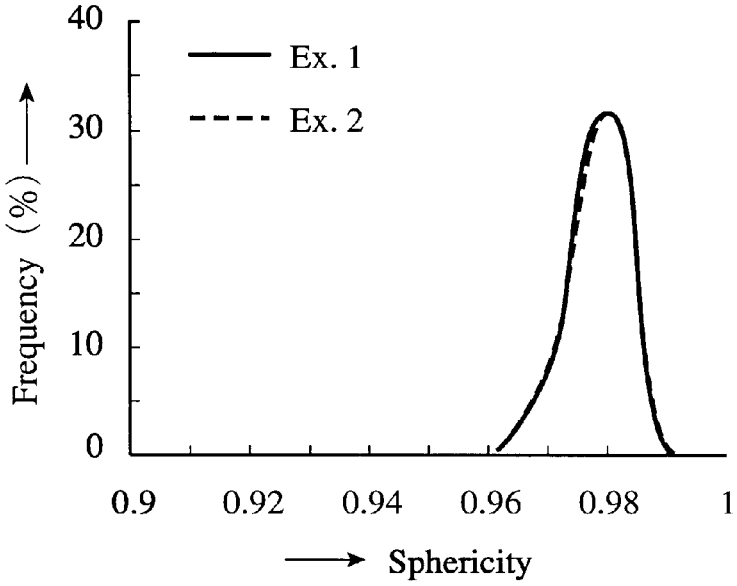

100 of the resultant solder balls were observed by a scanning-type electron microscope (SEM). By image analysis of an SEM image of each particle, a distribution of particle size (expressed by diameter of hypothetical circle corresponding to particle) and a distribution of sphericity (diameter of hypothetical circle/maximum diameter) were determined. The solid line in FIG. 10(*a*) shows a particle size distribution of the solder balls, and the solid line in FIG. 10(*b*) shows their sphericity distribution. As is clear from FIGS. 10(*a*) and (*b*), the resultant solder balls had a narrow particle size distribution and sphericity of 0.96 or more.

Example 2

To evaluate reproducibility in the production of solder balls, EXAMPLE 1 was repeated, and the resultant solder balls were measured with respect to their particle size distribution and sphericity distribution. The broken line in FIG. 10(*a*) shows a particle size distribution of the solder balls, and the broken line in FIG. 10(*b*) shows their sphericity distribution. As is clear from FIGS. 10(*a*) and (*b*), the production lot of EXAMPLE 1 was substantially the same as the production lot of EXAMPLE 2 in a particle size distribution and a sphericity distribution.

Comparative Example 1

Figure 11:
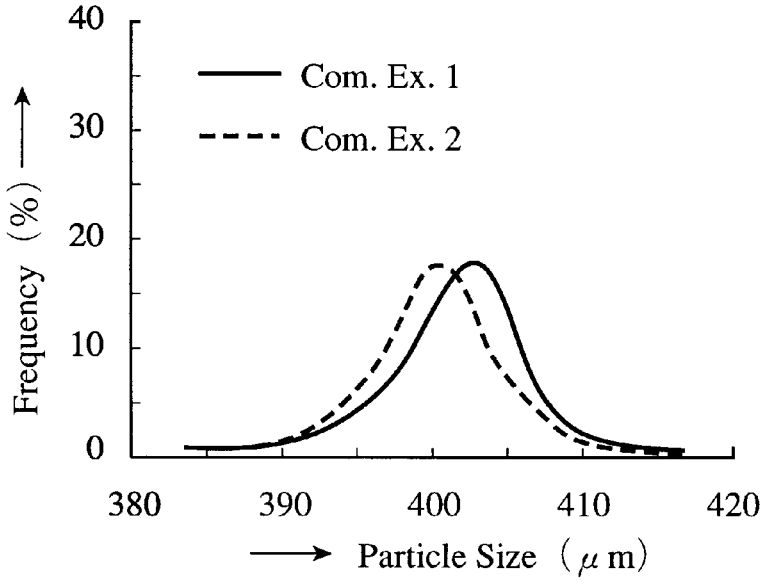
FIG. 11(*a*) is a graph showing particle size distributions of solder balls produced in COMPARATIVE EXAMPLES 1 and 2.
Figure 11:
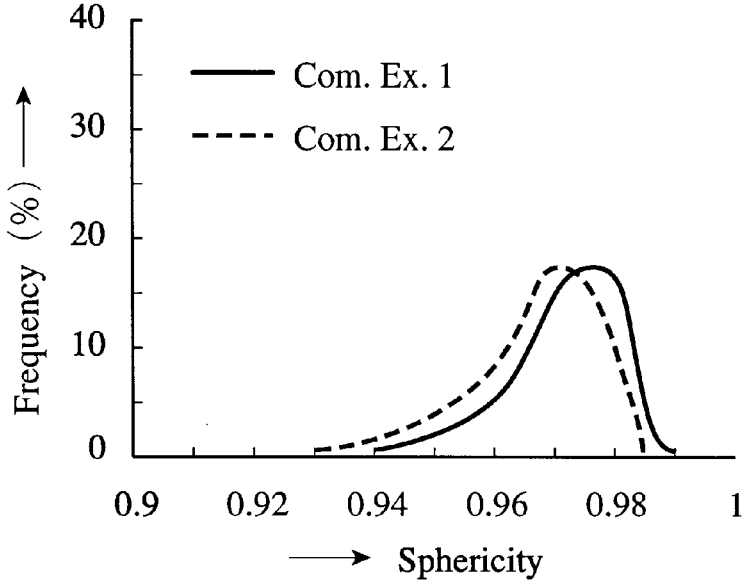
Figure 12:
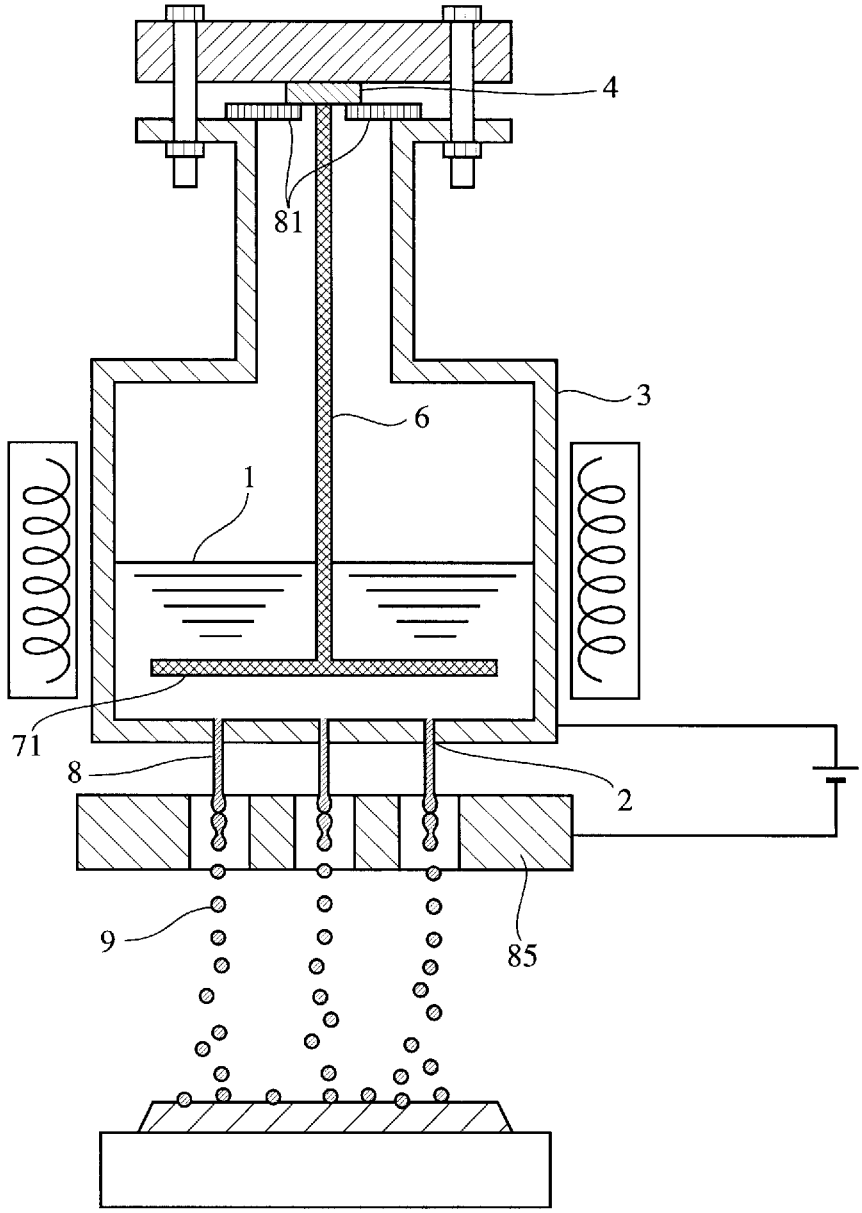
Fig. 12 Prior Art
FIG. 12 is a schematic cross-sectional view showing a uniform droplet-dropping apparatus disclosed in U.S. Pat. No. 5,266,098.

Using an apparatus comprising a piezoelectric vibrator 4 directly connected to a support member 11 instead of abutting the piezoelectric vibrator 4 to the support member 11 via the vibration-transmitting means 5, solder balls were produced under the same conditions as in EXAMPLE 1, to determine a particle size distribution and a sphericity distribution. The solid line in FIG. 11(*a*) shows a particle size distribution of the solder balls, and the solid line in FIG. 11(*b*) shows their sphericity distribution. As is clear from FIGS. 11(*a*) and (*b*), the resultant solder balls had a wide particle size distribution with poor sphericity.

Comparative Example 2

To evaluate reproducibility in the production of solder balls, COMPARATIVE EXAMPLE 1 was repeated, and the resultant solder balls were measured with respect to their particle size distribution and sphericity distribution. The broken line in FIG. 11(*a*) shows a particle size distribution of the solder balls, and the broken line in FIG. 11(*b*) shows their sphericity distribution. As is clear from FIGS. 11(*a*) and (*b*), the solder balls of COMPARATIVE EXAMPLES 1 and 2 had a wide particle size distribution and poor sphericity. In addition, the production lot of COMPARATIVE EXAMPLE 1 was largely different from the production lot of COMPARATIVE EXAMPLE 2 in a particle size distribution and a sphericity distribution.

Example 3

Using the apparatus for producing fine metal balls shown in FIG. 3, solder balls having the same shape as in EXAMPLE 1 were produced with a liquid nitrogen circulated in the cooling jacket 55. 3000 solder balls could be produced per 1 second per one orifice. No damage and deformation were appreciated on surfaces of the resultant solder balls, with sphericity of 0.95 or more. The SEM analysis of the concentrations of carbon and oxygen on the solder ball surfaces revealed that the concentrations of carbon and oxygen were less than detection limits.

Comparative Example 3

Using solder pieces of 100 μm in particle size cut from a solder wire having the same composition as in EXAMPLE 3 and a soybean oil, solder balls were produced by an in-oil spheroidizing method. The resultant solder balls were poorer than those of EXAMPLE 3 in both sphericity and particle size distributions as well as metal gloss. The SEM analysis of solder ball surfaces revealed that the solder balls were so contaminated that they had a carbon concentration of 23 atomic % and an oxygen concentration of 18 atomic %.

Comparative Example 4

Solder balls having the same shape as in EXAMPLE 3 were produced by a spherical, monodisperse particle production method (Japanese Patent Laid-Open No. 06-184607). 10 solder balls could be produced per 1 second per one orifice. The SEM analysis of the solder ball surfaces revealed that though the carbon concentration was less than a detection limit, the oxygen concentration was 32 atomic %. The reason therefor is that more oxidation took place than in the case of the in-oil spheroidizing method because solder balls were cooled in water.

Example 4

Using the apparatus for producing fine metal balls shown in FIG. 8, solder balls having a composition of Sn-2.0Ag–0.5Cu by mass % (average diameter: about 600 μm) were produced under the following conditions.

Melt temperature: 300° C.,

Number of vibration: 5 kHz,

Inner diameter of orifice: 405 μm,

Dimension of solidification chamber: inner diameter 0.3 m, and height 5 m,

Atmosphere in solidification chamber: Mixed gas of 8 volume % hydrogen and nitrogen, and Ejection time: 2 minutes.

The particle size distribution of solder balls was determined in the same manner as in EXAMPLE 1. The resultant solder balls had an average particle size of 601 μm, and the number of solder balls within an average particle size ±5% was 90% or more of the total number.

Comparative Example 5

Using the same apparatus as in EXAMPLE 4 under the same conditions as in EXAMPLE 4 except that a liquid nitrogen was not circulated in a cooling jacket 55, solder balls having the same shape as in EXAMPLE 4 were produced. The resultant solder balls had an average particle size of 592 μm, and the number of solder balls within an average particle size ±5% was 44% of the total number.

As described in detail above, the apparatus for producing fine metal balls according to the present invention can produce fine metal balls having a narrow particle size distribution and a high sphericity with good reproducibility. Also, using a means for attenuating the kinetic energy of the fine metal balls by a plurality of steps, it is possible to produce fine metal balls free from flaw, damage or deformation on their surfaces.

With a melt supply crucible disposed in addition to a melt-ejecting crucible, both being connected via a conduit to supply a melt from the melt supply crucible to the melt-ejecting crucible, continuous operation can be carried out for a long period of time. Also, by keeping a melt surface position in the melt-ejecting crucible constant by providing the melt supply crucible with an elevating means, the ejection speed of the melt can be kept constant.

By providing the solidification chamber with a temperature-controlling means to keep the temperature constant, the ejection speed can be kept constant, resulting in small unevenness in the particle sizes and shapes of melt droplets. It is thus possible to produce fine metal balls having a homogeneous solidification structure.

The apparatus for producing fine metal balls according to the present invention is suitable for the production of fine metal balls such as solder balls, which are so soft that they are easily damaged.

What is claimed is:

1. An apparatus for producing fine metal balls comprising a crucible for holding a metal melt and equipped with orifices for ejecting said metal melt; a vibration rod for giving vibration to said melt held in said crucible; a vibrator for giving vibration to said vibration rod; a means for transmitting the vibration of said vibrator to said vibration rod; and a chamber in which melt droplets ejected through said orifices are solidified while dropping, said vibration-transmitting means having one end in contact with said vibrator and the other end abutting a support member connected to said vibration rod; said vibration-transmitting means having a cross section decreasing as it nears said support member.

2. The apparatus for producing fine metal balls according to claim 1, wherein said vibration-transmitting means has a tip end portion substantially in a hemispherical or half-cylindrical shape.

3. The apparatus for producing fine metal balls according to claim 1, wherein said solidification chamber comprises a means for bounding the solidified fine metal balls a plurality of times so that the kinetic energy of said fine metal balls is attenuated by a plurality of steps.

4. An apparatus for producing fine metal balls comprising (a) a melt-ejecting means comprising a melt-ejecting crucible for holding a metal melt and equipped with orifices for ejecting said metal melt, a pressure-controlling means for controlling the pressure of said melt ejected through said orifices, and a vibration means for giving vibration to said melt; (b) a melt supplier comprising one or more melt supply crucibles for holding said melt, and one or more conduits connecting said melt supply crucibles to said melt-ejecting crucible; and (c) a solidification chamber in which melt droplets ejected through said orifices are solidified while dropping, wherein said vibration means comprises a vibration rod for giving vibration to said melt held in said melt-ejecting crucible, a vibrator for giving vibration to said vibration rod, and a means for transmitting the vibration of said vibrator to said vibration rod, said vibration-transmitting means having one end in contact with said vibrator and the other end abutting a support member connected to said vibration rod, and said vibration-transmitting means having a cross section decreasing as it nears said support member.

5. The apparatus for producing fine metal balls according to claim 4, wherein said melt supply crucible is equipped with a metal material-supplying means.

6. The apparatus for producing fine metal balls according to claim 4, wherein said melt supply crucible is equipped with an elevating means for moving said melt supply crucible in a vertical direction.

7. The apparatus for producing fine metal balls according to claim 4, wherein said melt supply crucible is equipped with a means for detecting a surface position of said melt held therein.

8. The apparatus for producing fine metal balls according to claim 4, wherein said melt supply crucible is equipped with a load cell for detecting the change of the weight of said melt held therein.

9. The apparatus for producing fine metal balls according to claim 4, wherein each of said melt-ejecting crucible and said melt supply crucible is equipped with a gas-pressure controlling means for controlling a gas pressure applied to a surface of said melt held therein.

10. The apparatus for producing fine metal balls according to claim 9, wherein an inert gas or a reducing gas is used as a gas for controlling gas pressure applied to a surface of said melt.

11. An apparatus for producing fine metal balls comprising a melt-ejecting means comprising a crucible for holding a metal melt and equipped with orifices for ejecting said metal melt, and a vibration means for giving vibration to said melt; a chamber in which melt droplets ejected through said orifices are solidified while dropping; said apparatus further comprising a heat-exchanging means for controlling the temperature of an atmosphere inside said solidification chamber, wherein said vibration means comprises a vibration rod for giving vibration to said melt held in said melt-ejecting crucible, a vibrator for giving vibration to said vibration rod, and a means for transmitting the vibration of said vibrator to said vibration rod; said vibration-transmitting means having one end in contact with said vibrator and the other end abutting a support member connected to said vibration rod, and said vibration-transmitting means having a cross section decreasing as it nears said support member.

12. The apparatus for producing fine metal balls according to claim 11, wherein said heat-exchanging means comprises a heat-exchanging portion mounted onto an inner wall of said solidification chamber, a coolant circulating in said heat-exchanging portion, and a temperature controller for controlling the temperature of said coolant.

13. The apparatus for producing fine metal balls according to claim 11, wherein said heat-exchanging means comprises a sub-chamber connected to said solidification chamber such that a gas can be circulated therebetween, a heat-exchanging portion mounted in said sub-chamber, a coolant circulating in said heat-exchanging portion, and a temperature controller for controlling the temperature of said coolant.

14. The apparatus for producing fine metal balls according to claim 13, wherein said temperature controller controls the temperature of said coolant based on a gas temperature detected by a thermometer mounted in said solidification chamber.

* * * * *